United States Patent [19]

DeCloux

[11] Patent Number: 4,681,316

[45] Date of Patent: Jul. 21, 1987

[54] PHASING SYSTEM FOR EXERCISE STAIR

[76] Inventor: Richard J. DeCloux, 1485 Belmont St., Manchester, N.H. 03104

[21] Appl. No.: 636,907

[22] Filed: Aug. 2, 1984

[51] Int. Cl.[4] ..... A63B 21/00; A63B 23/04

[52] U.S. Cl. ..... 272/130; 272/70

[58] Field of Search ..... 272/130, 134, 69, 70, 272/72; 91/520; 128/25 R

[56] References Cited

U.S. PATENT DOCUMENTS

| | | | |
|---|---|---|---|
| 2,079,594 | 5/1937 | Clem | 128/25 R |
| 3,266,801 | 8/1966 | Johnson | 272/72 |
| 3,497,215 | 2/1970 | Harrison et al. | 272/69 |
| 3,606,318 | 9/1971 | Gilstrap | 272/72 |
| 3,702,188 | 11/1972 | Phillips et al. | 272/130 |
| 3,774,696 | 11/1973 | Horsch | 91/520 |
| 3,822,599 | 7/1974 | Brentham | 272/130 |
| 3,970,302 | 7/1976 | McFee | 272/70 |
| 4,063,726 | 12/1977 | Wilson | 272/130 |
| 4,363,481 | 12/1982 | Erickson | 128/25 R |
| 4,465,274 | 8/1984 | Davenport | 272/130 |
| 4,496,147 | 1/1985 | DeCloux et al. | 272/130 |

*Primary Examiner*—Richard J. Apley
*Assistant Examiner*—S. R. Crow
*Attorney, Agent, or Firm*—Weingarten, Schurgin, Gagnebin & Hayes

[57] ABSTRACT

Apparatus for use with an exercise device in the form of moveable stairs mounted to tracks includes a stair step phasing system that absorbs and dissipates energy and provides adjustment of stroke length and cycle rate for various aerobic and isokinetic exercise activities through the use of a unique bypass system. The phasing system includes two double-acting cylinders with hydraulically-phased pistons having rods connected to respective steps. The hydraulic system is a closed system having fluid both above and below the pistons, with the phasing system including interconnection of the cylinders so that the cylinder portion above the piston of each cylinder is hydraulically connected to the cylinder portion above the piston of the other cylinder, and the cylinder portion below the piston of each cylinder is similarly connected. It is a feature of this invention that a bypass is provided connecting the cylinder portions above the pistons of the system to the cylinder portions below the pistons of the system. A valve is provided in the bypass which when open allows fluid to move from above the pistons to below the pistons allowing adjustment of the position of the pistons relative to the cylinders and each other, and which when closed fixes the piston relationships. A variable orifice in either or both of the intercylinder connections facilitates the adjustment of the rate of piston movement in relation to force applied. The closed system is also provided with one or more accumulators for accommodation of hydraulic fluid thermal expansion.

6 Claims, 2 Drawing Figures

PHASING SYSTEM FOR EXERCISE STAIR

FIELD OF INVENTION

This invention relates to stair climbing type exercise devices and, more particularly, to a hydraulic system that absorbs and dissipates energy and controls the related exercise parameters of force, rate and length of stroke of the stair steps.

BACKGROUND OF THE INVENTION

Present hydraulic exercise absorption/control systems for exercise stair devices were devised to offer improved features over older mechanical systems. The most notable of these are Olson et al, U.S. Pat. No. 3,529,474; and Crum et al, U.S. Pat. No. 3,758,112. Neither of these systems provide hydraulic stroke length and adjustment of hydraulically-phased pistons connected to exercise steps. Stroke as used herein refers to the length of travel of the steps in the exercise stair device and, likewise, to the extension of the piston rod attached to the associated step.

Adjustment of stroke length is a very necessary comfort/effectiveness feature in many aerobic and isokinetic exercise activities. Further, for hydraulic exercise absorption and dissipation control systems employing pistons where some leakage of fluid around the piston seals is inevitable, provision for re-establishing stroke is mandatory if the device is to have an acceptable life in relation to use.

Present hydraulic exercise absorption and dissipation control systems phase the pistons either mechanically or hydraulically. Regardless of how the pistons are phased, the stroke length is adjusted (if at all) only by movement of mechanical components such as stops or lever arms.

Quick, convenient adjustment of stroke length is a very desirable feature for any particular user of most exercise equipment. It becomes a comfort/effectiveness necessity when the equipment is used by many people ranging from large to small and fit to infirm. Further, it is mandatory that the usable maximum stroke of the machine not degrade with use over the life of the machine, as can readily happen in piston-based hydraulic systems that do not provide for return of fluid lost past piston seals and for the adjustment of stroke.

SUMMARY OF THE INVENTION

The subject system provides hydraulic step phasing of reciprocating exercise activity with hydraulic selection of the mechanical stroke reference and stroke length. The subject system conserves and returns fluid lost past piston seals and restricts the change of stroke length due to temperature increase to one times the rate of the fluid of thermal expansion (%/degree). Moreover, the subject system provides exercise operation in either a push or a pull mode.

In one embodiment, the subject phasing system is a hydraulic system having a pair of double-acting cylinders, hydraulically interconnected both above and below the limit of piston travel, and operating as a closed system. The system is divided into two isolated chambers by the piston seals. The system is entirely filled with hydraulic fluid except for expansion chambers sized and filled appropriately to accommodate thermal expansion of the hydraulic fluid with reasonable thermally-induced pressure increases. Depending on the position of the pistons in the cylinders when the fluid is introduced, the movement of the pistons is limited mechanically at either the top of their stroke or the bottom of their stroke. If the pistons are positioned so as to be limited at the bottom of their stroke, the stroke length is proportional to the combined volume of the two cylinders between the bottom of the pistons and the bottom limit of their movement. Conversely, if the pistons are positioned so that their travel is limited at the top of their stroke, the length of stroke is proportional to the combined volume of both cylinders between the tops of the pistons and the top limit of their movement.

The subject phasing system makes stroke adjustment possible by providing a bypass passage made operable by the opening of a valve that allows fluid to flow from/to the chamber portion below a piston to/from the chamber portion above the piston, thereby unlocking the hydraulically-fixed relationship of the pistons to the top or bottom mechanical limit, and to each other. This bypass allows easy and precise positioning of the pistons. To select either top or bottom stroke limiting, the user opens the bypass valve and positions one of the pistons against the limit of choice. To set the stroke length, the other piston is positioned such that the distance between the pistons is equal to the desired stroke length. The bypass valve is then closed to hydraulically lock the selected piston-to-piston and pistons-to-cylinder relationships.

The subject phasing system has a variable orifice in either or both of the intercylinder connections to allow the user to vary the piston speed/force characteristics of the system.

In summary, apparatus for use with an exercise device in the form of moveable stairs mounted to tracks includes a stair step phasing system that absorbs and dissipates energy and provides adjustment of stroke length and cycle rate for various aerobic and isokinetic exercise activities through the use of a unique bypass system. The phasing system includes two double-acting cylinders with hydraulically-phased pistons having rods connected to respective steps. The hydraulic system is a closed system having fluid both above and below the pistons, with the phasing system including interconnection of the cylinders so that the cylinder portion above the piston of each cylinder is hydraulically connected to the cylinder portion above the piston of the other cylinder, and cylinder portion below the piston of each cylinder is similarly connected. It is a feature of this invention that a bypass is provided connecting the cylinder portions above the pistons of the system to the cylinder portions below the pistons of the system. A valve is provided in the bypass which when open allows fluid to move from above the pistons to below the pistons allowing adjustment of the position of the pistons relative to the cylinders and each other, and which when closed fixes the piston relationship. A variable orifice in either or both of the intercylinder connections facilitates the adjustment of the rate of piston movement in relation to force applied. The closed system is also provided with one or more accumulators for accommodation of hydraulic fluid thermal expansion.

BRIEF DESCRIPTION OF THE DRAWINGS

These and other features of the subject invention will be better understood taken in conjunction with the Detailed Description and the drawings of which.

DETAILED DESCRIPTION

Figure 1:
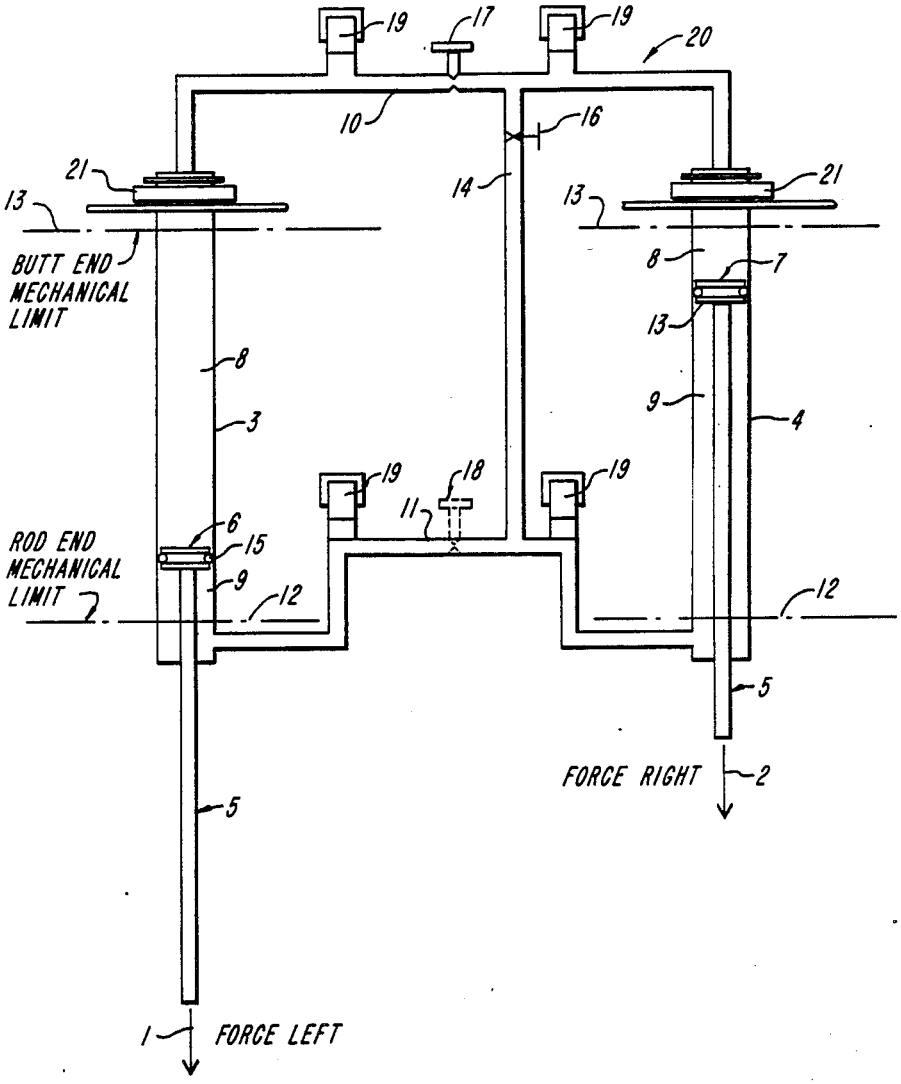
FIG. 1 is a schematic diagram of the subject hydraulic phasing system.

The subject exercise energy absorption and dissipation control system provides hydraulically-phased, reciprocating pistons; hydraulic selection and adjustment of stroke mechanical reference and stroke length; conservation and return of fluid lost past piston seals; and an essentially one-to-one relationship between change of stroke length and change of fluid volume as the result of thermal expansion. Referring now to FIG. 1, in one embodiment and in one exercise application, a force left 1 and force right 2 represent the effort of the user applied cyclically to double-acting cylinders 3 and 4 piston rods 5 which are alternately put in tension by the user applying force to a step (not shown in this figure) causing first one piston 6 and then the other 7 to descend through its stroke, forcing fluid 8 and 9 through the intercylinder connection conduits 10 and 11 and causing the other piston to rise as the first descends. The downward travel of the piston being pulled by the exerciser is limited (as selected) by either the descending piston encountering the rod end mechanical limit 12 or the rising nonpowered piston encountering the butt end mechanical limit 13.

The length of stroke is the combined distances between each piston and the selected mechanical reference. Either the rod end or butt end mechanical reference can be selected as the stroke limiter by use of bypass conduit 14 which allows fluid 8 confined above the pistons by piston seals 15 to be added to fluid 9 confined below the pistons. Note, the bypass also allows the transfer of fluid in the opposite direction. The bypass has a shut-off valve 16 which when open makes the bypass operative, allowing one of the pistons to be placed against either the rod end mechanical limit or the butt end mechanical limit establishing the selected stop as the stroke limiter. With the bypass valve open and one piston at the selected mechanical limit, the desired stroke length can be set by positioning the other piston a distance away from the selected mechanical limit equal to the desired length of stroke. The selected stroke limit and length of stroke are then fixed by closing the bypass valve. This adjustment capability is used to accommodate user difference in preferred stroke length and to recapture fluid lost past the piston seals.

Various orifice means 17 and 18 in intercylinder connections 10 and 11 provide an adjustment in the rate of piston movement in relation to force applied. Note that only one variable orifice need be used. Thus variable orifice means 18 is shown in dotted outline.

One or more expansion chambers 19 is provided to accommodate the expansion of fluid resulting from the temperature rise inherent in one of the basic functions of the device, the absorption of energy output of the user, conversion of that energy into heat, and release of that heat to the environment. Sizing of the chambers and the spring constant (or compressibility) of the material or device in the chambers is a function of the exercise energy input rate, the convection/radiation cooling rate, the use sensitivity to "sponginess," and the pressure limitations of the components. As such the apparatus shown in FIG. 1 constitutes a phasing system 20 for the stair climbing exercise device of FIG. 2.

With accommodation of fluid thermal expansion by chambers all on one side of the pistons, it can be seen that the length of stroke will change with fluid temperature increase at the same percentage as the fluid volume on the selected mechanical limit side of the pistons. In special exercise applications of the subject device where the selected mechanical limit and the stroke length can be predicted, selected disposition of expansion chambers on both sides of the pistons can be made to reduce change of stroke due to thermal expansion to a fraction of the percent the fluid volume expands with temperature.

In one embodiment, each cylinder 3 and 4 is provided with a flexible mounting member 21 which, when used with conduits 10, 11 and 14, and when these conduits are made flexible, permits the cylinders to align with the direction of the force applied so as to reduce seal wear due to side thrust.

Figure 2:
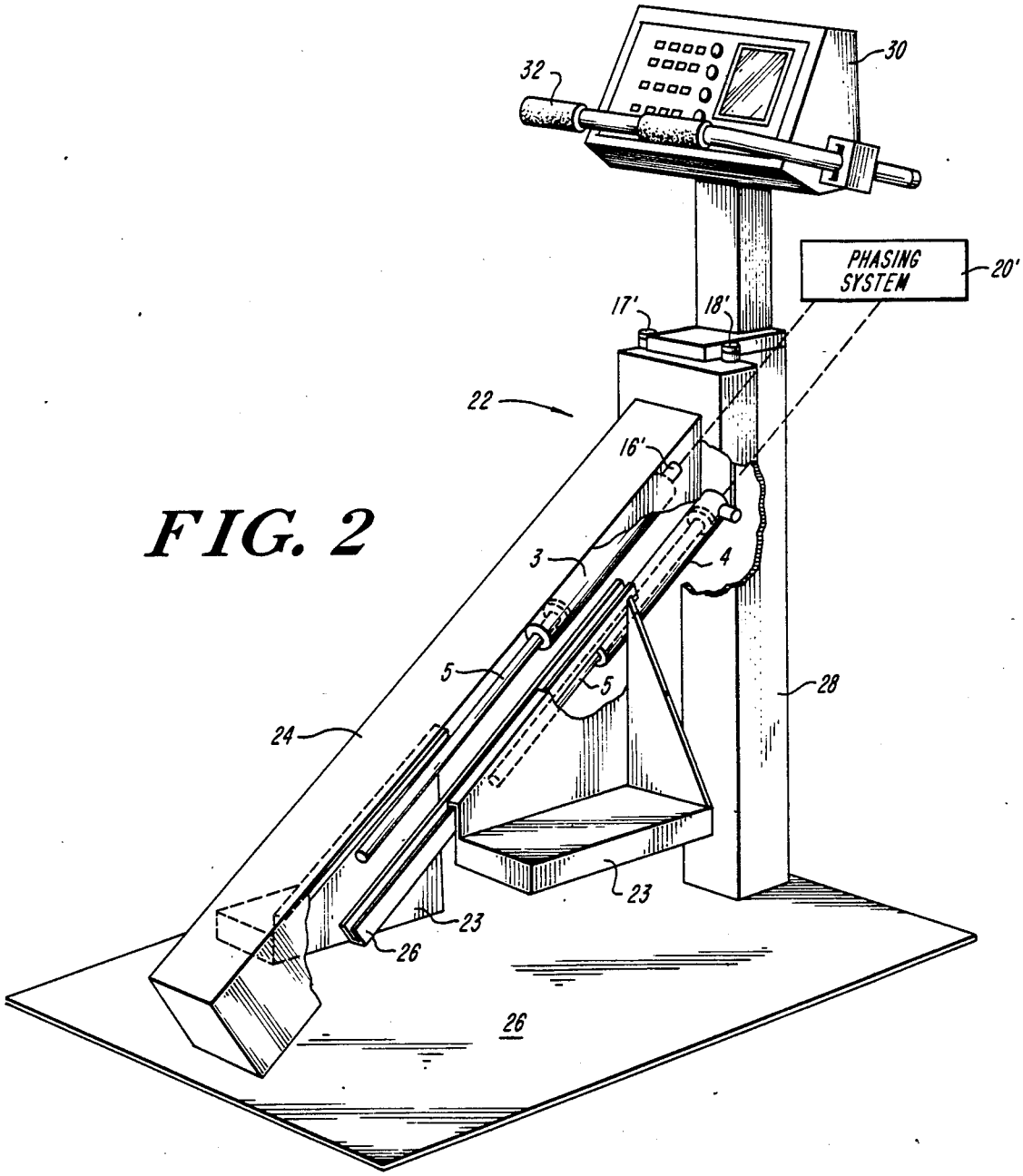
FIG. 2 is a diagrammatic illustration of the use of the system of FIG. 1 with an exercise stair device.

Referring now to FIG. 2, a stair climbing exercise device 22 is indicated as having steps 23, each of which is attached to the rod 5 of a corresponding cylinder 3 or 4 mounted within the slanted support 24 which has therein guides 26 for mounting steps 23 so that they may translate along this inclined support and grooved structure. Lever 16' corresponds to valve 16 of FIG. 1 which forms the aforementioned bypass between the top and bottom portions of each of the cylinders involved, such that an individual can adjust the structure of the steps by adjusting the stroke of the pistons as described in connection with FIG. 1. Note that exercise device 22 has a base 26 and an upright position 28 on which is mounted a display console 30 and handle bars 32. Accumulators 17' and 18' are mounted to the exercise device and are part of the phasing system 20 to FIG. 1, here shown at 20', it being understood that the phasing system is housed within the exercise device.

Having above indicated a preferred embodiment of the present invention, it will occur to those skilled in the art that modification and alternative can be practiced within the spirit of the invention. It is accordingly intended to define the scope of the invention only as indicated in the following claims:

What is claimed is:

1. An exercise system having linearly reciprocating steps comprising:

a pair of stair steps;

a frame;

a pair of hydraulic cylinders, each having a piston coupled to a respective stair step, and respectively mounted to said frame such that the pistons linearly reciprocate in response to pressure applied to the respective steps;

intercylinder fluid coupling means including intercylinder fluid coupling passages for fluid coupling each side of each of the cylinders together on corresponding sides of their pistons so that the movement of one piston by its associated step moves the other piston in the reverse direction by action of the fluid moving in the intercylinder fluid coupling means;

bypass means including at least one bi-directional fluid coupling passage and valve means therein, for selectively coupling when the valve means is in an open position, the fluid on one side of at least one of the pistons to the fluid on the other side of said at least one piston;

said bypass means operative with the valve means in an open position, to permit fluid coupling through the bi-directional fluid coupling passage to allow adjustment of relative piston position and range of motion; and said bypass means further operative with said valve means in a closed position to block fluid coupling through the bi-directional fluid coupling passage during exercise use.

2. The exercise system of claim 1 and further including a variable orifice in an intercylinder fluid coupling passage.

3. The exercise system of claim 2 and further including an expansion chamber on one side of one of the pistons to accommodate thermal expansion of hydraulic fluid.

4. The exercise system of claim 3 and further including flexible, nonlinear means of intercylinder fluid coupling to reduce side thrust on cylinder components.

5. The exercise system of claim 4 and further including flexible cylinder mounts so as to reduce side thrust on cylinder components.

6. The exercise of claim 1 wherein said bypass means connects the liquid above both pistons in respective cylinders to that below the associated pistons in the respective cylinders.

* * * * *